US010578386B1

(12) United States Patent
Gomez

(10) Patent No.: US 10,578,386 B1
(45) Date of Patent: Mar. 3, 2020

(54) FIREARM TRIGGER

(71) Applicant: Robert Alan Gomez, Alamo, CA (US)

(72) Inventor: Robert Alan Gomez, Alamo, CA (US)

( * ) Notice: Subject to any disclaimer, the term of this patent is extended or adjusted under 35 U.S.C. 154(b) by 0 days.

(21) Appl. No.: 16/104,353

(22) Filed: Aug. 17, 2018

(51) Int. Cl.
*F41A 19/10* (2006.01)

(52) U.S. Cl.
CPC ..... *F41A 19/10* (2013.01)

(58) Field of Classification Search
CPC ..... F41A 19/10
USPC ..... 42/69.01; 124/31
See application file for complete search history.

(56) References Cited

U.S. PATENT DOCUMENTS 2,433,309 A * 12/1947 Van Karner ..... F41A 19/42 124/31
6,651,642 B1 * 11/2003 Powers ..... F41B 5/1469 124/31
9,696,104 B1 * 7/2017 Bloomfield ..... F41A 19/10
10,247,503 B2 * 4/2019 Bloomfield ..... F41A 19/10

OTHER PUBLICATIONS

Les Voth, A Case for Competition, Aug. 6, 2018, Long Range Hunting Online Magazine, pp. 1-9 (Year: 2018).*

* cited by examiner

*Primary Examiner* — Stephen Johnson
*Assistant Examiner* — Benjamin S Gomberg
(74) *Attorney, Agent, or Firm* — Bennet K. Langlotz; Langlotz Patent & Trademark Works, LLC

(57) ABSTRACT

A firearm trigger has a trigger body, the trigger body having an elongated forward actuation surface, the forward actuation surface including a plurality of spaced-apart protrusions, and the protrusions being arranged in an elongated array. The protrusions may be convex hemispheres. The protrusions may be round. The protrusions may be positively curved surfaces. The protrusions may be surfaces of revolution. The protrusions may be spaced apart from each other by portions of the forward actuation surface. The protrusions may be arranged in a pair of rows each extending along the length of the forward actuation surface. The forward actuation surface may include opposed edge portions, and each row may be proximate to a respective one of the edge portions. Each row may contain at least three protrusions. Each row may contain at most six protrusions.

19 Claims, 5 Drawing Sheets

FIREARM TRIGGER

FIELD OF THE INVENTION

The present invention relates to triggers for projectile weapons and, more particularly, to a firearm trigger featuring a plurality of spaced-apart protrusions.

BACKGROUND OF THE INVENTION

Many people suffer from diminished touch sensation in their hands and fingers. This condition can result from a variety of causes, including thick calluses and peripheral neuropathy caused by damage to peripheral nerves. Peripheral neuropathy can result from many factors, including normal ageing, compression of nerves in the neck or carpal tunnel, diseases such as diabetes mellitus, and occupational exposure to neurotoxins, among others.

Reduced sensitivity to touch can make it difficult for a person to safely and accurately operate a firearm because of a lack of sensitivity to the forward actuation surface of the firearm's trigger. An inability to properly sense the trigger's location and pressure can result in unintentional or unexpected discharge of a firearm. Furthermore, people with normal sensation in their fingers can still have difficulty sensing the trigger's location and pressure, particularly if they are inexperienced at shooting a firearm.

Therefore, a need exists for a new and improved firearm trigger with a plurality of spaced-apart protrusions to maximize the sensory receptor/nerve stimulation on the palmar aspect of the finger being used to pull the firearm trigger. In this regard, the various embodiments of the present invention substantially fulfill at least some of these needs. In this respect, the firearm trigger according to the present invention substantially departs from the conventional concepts and designs of the prior art, and in doing so provides an apparatus primarily developed for the purpose of maximizing the sensory receptor/nerve stimulation on the palmar aspect of the finger being used to pull the firearm trigger. The protrusions of the current invention to be described (≤2 mm) will initially cause stimulation of a more superficial layer of skin receptors (Meissner's corpuscles). Larger protrusions (>2 mm) will also stimulate a deeper layer of different skin receptors (Pacinian corpuscles), maximizing the sensory feedback from the fingertip. Differently sized protrusions will be appropriate for varying degrees of sensory neuropathy. It should also be appreciated that the protrusions of the current invention are deliberately larger than those for braille/California braille. Braille is for use by people with normal or supernormal fingertip sensation, whereas the current invention can be used by people with impaired, normal, or supernormal fingertip sensation. Also, although grip may be improved by the protrusions of the current invention, that is not a primary purpose of these protrusions.

SUMMARY OF THE INVENTION

The present invention provides an improved firearm trigger, and overcomes the above-mentioned disadvantages and drawbacks of the prior art. As such, the general purpose of the present invention, which will be described subsequently in greater detail, is to provide an improved firearm trigger that has all the advantages of the prior art mentioned above.

To attain this, the preferred embodiment of the present invention essentially comprises a trigger body, the trigger body having an elongated forward actuation surface, the forward actuation surface including a plurality of spaced-apart protrusions, and the protrusions being arranged in an elongated array. The protrusions may be convex hemispheres. The protrusions may be round. The protrusions may be positively curved surfaces. The protrusions may be surfaces of revolution. The protrusions may be spaced apart from each other by portions of the forward actuation surface. The protrusions may be arranged in a pair of rows each extending along the length of the forward actuation surface. The forward actuation surface may include opposed edge portions, and each row may be proximate to a respective one of the edge portions. Each row may contain at least three protrusions. Each row may contain at most six protrusions. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
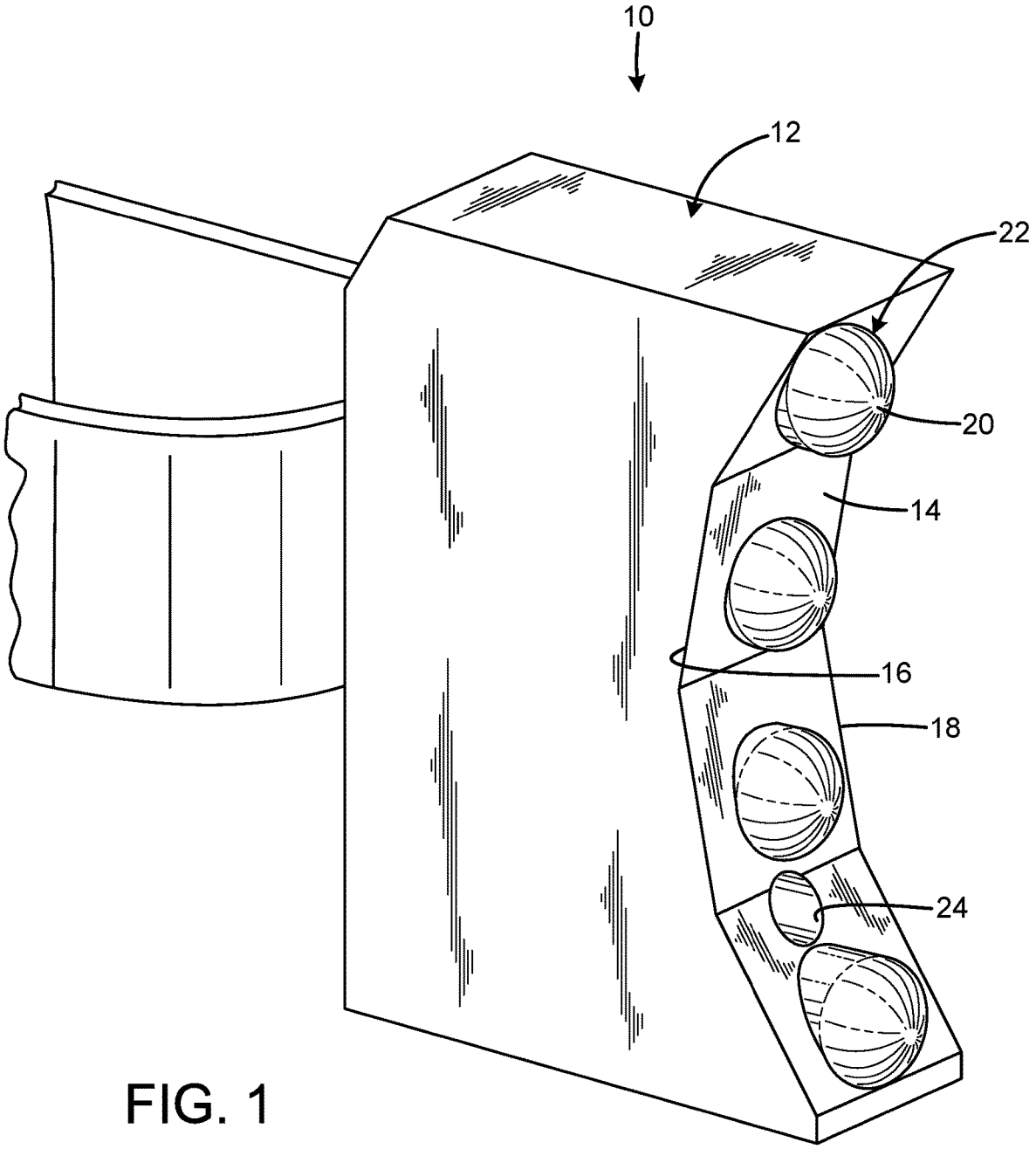
FIG. 1 is a front isometric fragmentary view of the current embodiment of the firearm trigger constructed in accordance with the principles of the present invention for use with a 1911 pistol.

An embodiment of the firearm trigger of the present invention is shown and generally designated by the reference numeral 10.

FIG. 1 illustrates the improved firearm trigger 10 of the present invention. More particularly, the firearm trigger is suitable for use with a 1911 pistol. The firearm trigger has a trigger body 12 that includes an elongated forward actuation surface 14 with opposed edge portions 16, 18. The forward actuation surface includes four spaced-apart protrusions 20 that are arranged in an elongated array/column 22 along the length of the forward actuation surface and defines a forward-facing aperture 24. The protrusions are spaced apart from each other by portions of the forward actuation surface. In the current embodiment, the protrusions are convex hemispheres, round, positively curved surfaces, surfaces of revolution, and have a vertical dimension along the length of the forward actuation surface and a perpendicular lateral dimension equal to the vertical dimension. In the current embodiment, the protrusions have a diameter of at least 1 mm and no greater than 5 mm, a height of at least 1 mm and no greater than 4 mm, and a center to center distance of at least 2 mm and no greater than 10 mm. The protrusions can also be flat or cone-shaped instead of round.

Figure 2:
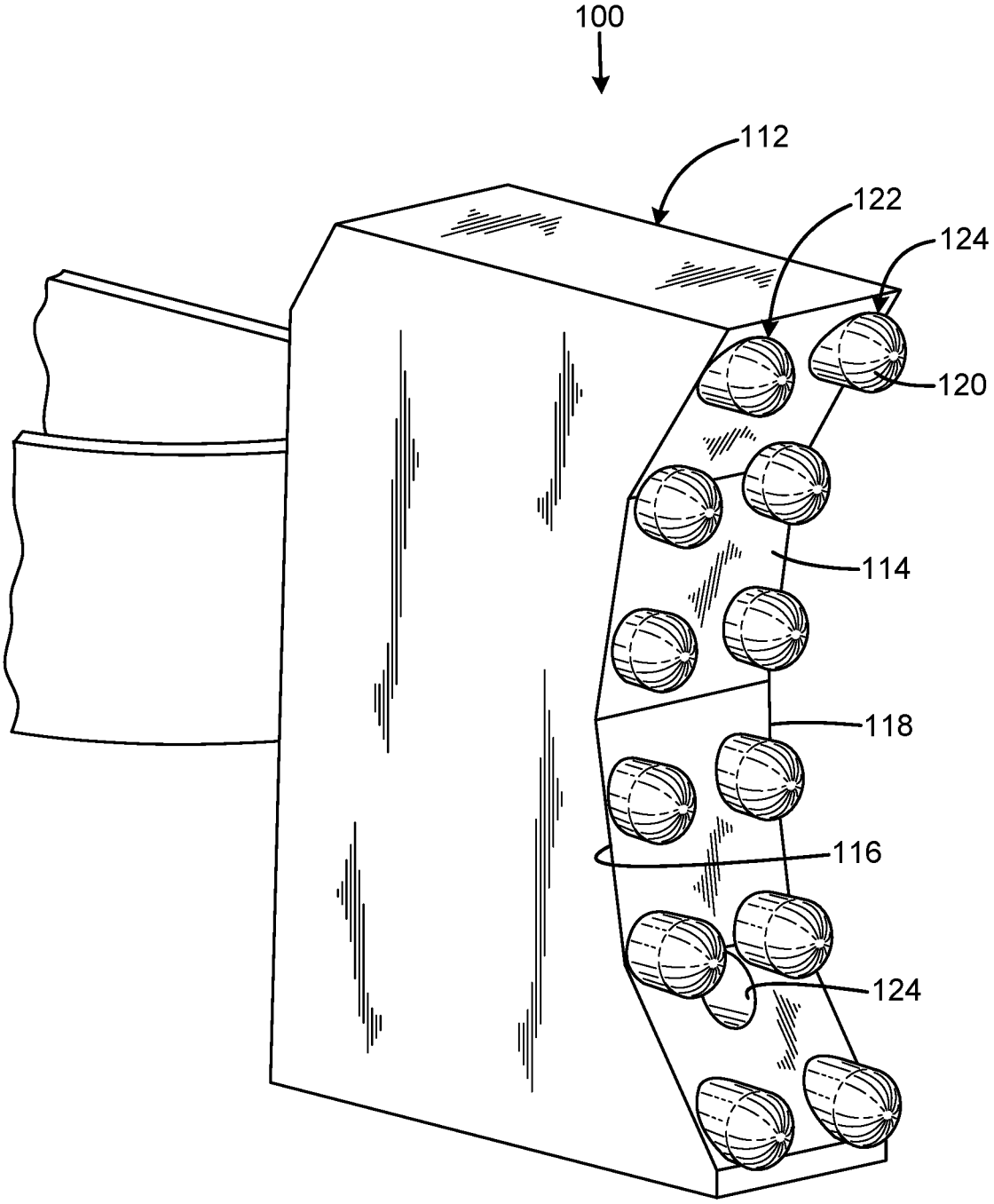
FIG. 2 is a front isometric fragmentary view of a first alternative embodiment of the firearm trigger constructed in accordance with the principles of the present invention for use with a 1911 pistol.

FIG. 2 illustrates a first alternative embodiment of the improved firearm trigger 100 of the present invention. More particularly, the firearm trigger is suitable for use with a 1911 pistol. The firearm trigger has a trigger body 112 that includes an elongated forward actuation surface 114 with opposed edge portions 116, 118. The forward actuation surface includes twelve spaced-apart protrusions 120 that are arranged in a pair of elongated arrays/columns 122, 124 along the length of the forward actuation surface and defines a forward-facing aperture 126. Each column has six protrusions and is proximate to a respective one of the opposed edge portions. The protrusions are arranged in a plurality of pairs of adjacent protrusions and are spaced apart from each other by portions of the forward actuation surface. The pairs are distributed along the length of the forward actuation surface. In the current embodiment, the protrusions are convex hemispheres, round, positively curved surfaces, surfaces of revolution, and have a vertical dimension along the length of the forward actuation surface and a perpendicular lateral dimension equal to the vertical dimension. In the current embodiment, the protrusions have a diameter of at least 1 mm and no greater than 5 mm, a height of at least 1 mm and no greater than 4 mm, and a center to center distance of at least 2 mm and no greater than 10 mm within a single column and between adjacent columns. The protrusions can also be flat or cone-shaped instead of round.

Figure 3:
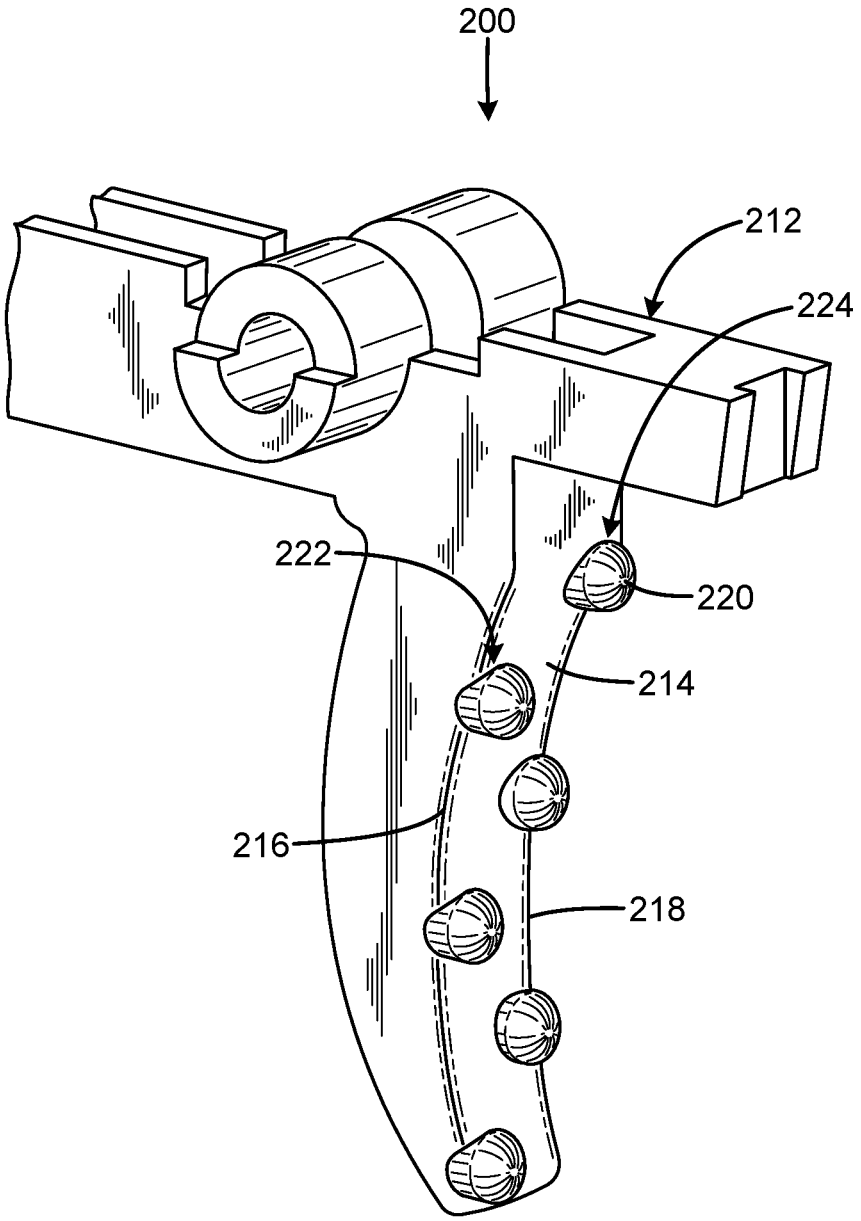
FIG. 3 is a front isometric fragmentary view of a second alternative embodiment of the firearm trigger constructed in accordance with the principles of the present invention for use with an AR-15 rifle.

FIG. 3 illustrates a second alternative embodiment of the improved firearm trigger 200 of the present invention. More particularly, the firearm trigger is suitable for use with an AR-15 rifle. The firearm trigger has a trigger body 212 that includes an elongated forward actuation surface 214 with opposed edge portions 216, 218. The forward actuation surface includes six spaced-apart protrusions 220 that are arranged in a pair of elongated arrays/columns 222, 224 along the length of the forward actuation surface. Each column has three protrusions and is proximate to a respective one of the opposed edge portions. The protrusions of each column or staggered with respect to the protrusions of the other column. The protrusions are spaced apart from each other by portions of the forward actuation surface and are distributed along the length of the forward actuation surface. In the current embodiment, the protrusions are convex hemispheres, round, positively curved surfaces, surfaces of revolution, and have a vertical dimension along the length of the forward actuation surface and a perpendicular lateral dimension equal to the vertical dimension. In the current embodiment, the protrusions have a diameter of at least 1 mm and no greater than 5 mm, a height of at least 1 mm and no greater than 4 mm, and a center to center distance of at least 2 mm and no greater than 10 mm within a single column and between adjacent columns. The protrusions can also be flat or cone-shaped instead of round.

Figure 4:
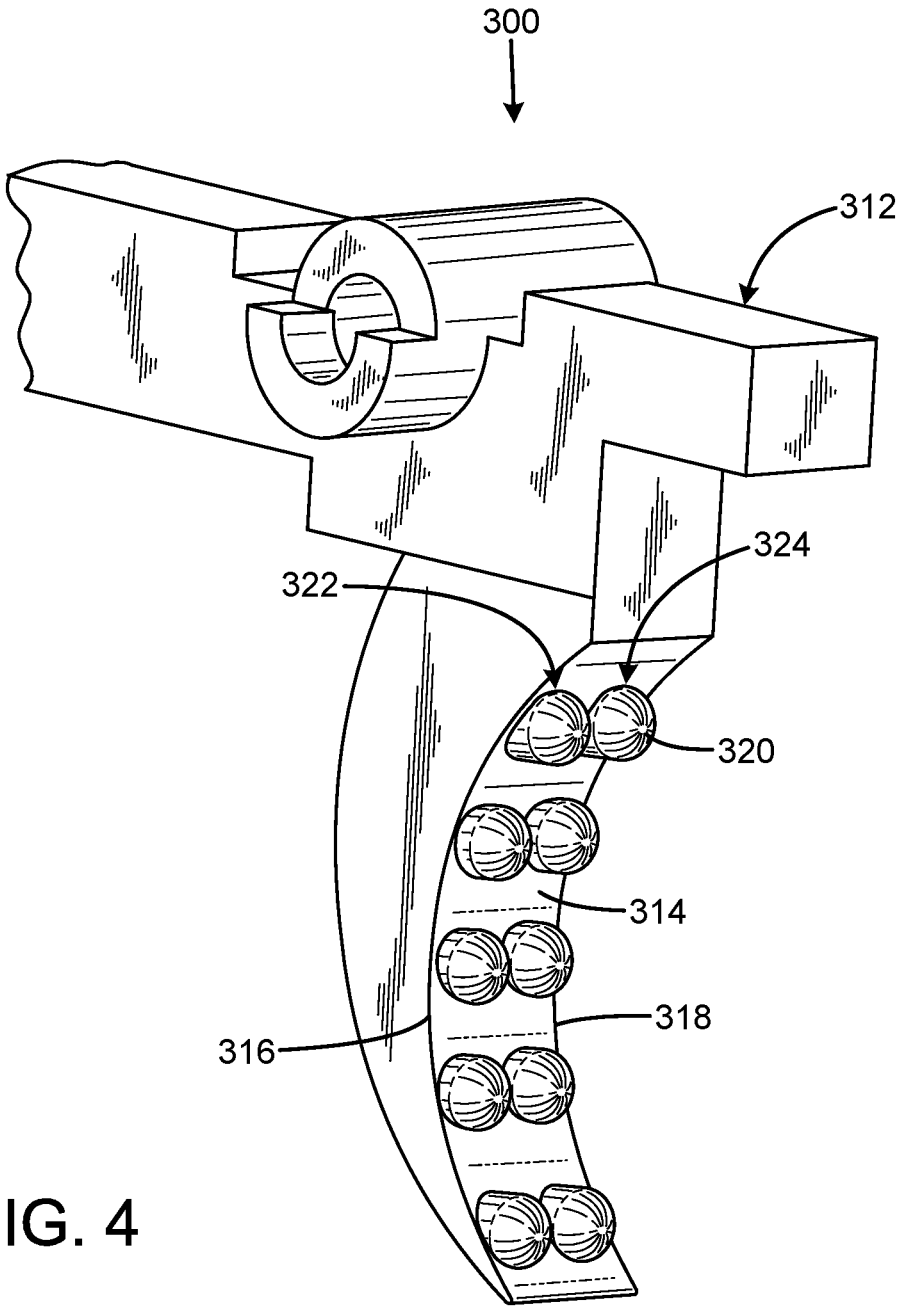
FIG. 4 is a front isometric fragmentary view of a third alternative embodiment of the firearm trigger constructed in accordance with the principles of the present invention for use with an AR-15 rifle.

FIG. 4 illustrates a third alternative embodiment of the improved firearm trigger 300 of the present invention. More particularly, the firearm trigger is suitable for use with an AR-15 rifle. The firearm trigger has a trigger body 312 that includes an elongated forward actuation surface 314 with opposed edge portions 316, 318. The forward actuation surface includes ten spaced-apart protrusions 320 that are arranged in a pair of elongated arrays/columns 322, 324 along the length of the forward actuation surface. Each column has five protrusions and is proximate to a respective one of the opposed edge portions. The protrusions are arranged in a plurality of pairs of adjacent protrusions and are spaced apart from each other by portions of the forward actuation surface. The pairs are distributed along the length of the forward actuation surface. In the current embodiment, the protrusions are convex hemispheres, round, positively curved surfaces, surfaces of revolution, and have a vertical dimension along the length of the forward actuation surface and a perpendicular lateral dimension equal to the vertical dimension. In the current embodiment, the protrusions have a diameter of at least 1 mm and no greater than 5 mm, a height of at least 1 mm and no greater than 4 mm, and a center to center distance of at least 2 mm and no greater than 10 mm within a single column and between adjacent columns. The protrusions can also be flat or cone-shaped instead of round.

Figure 5:
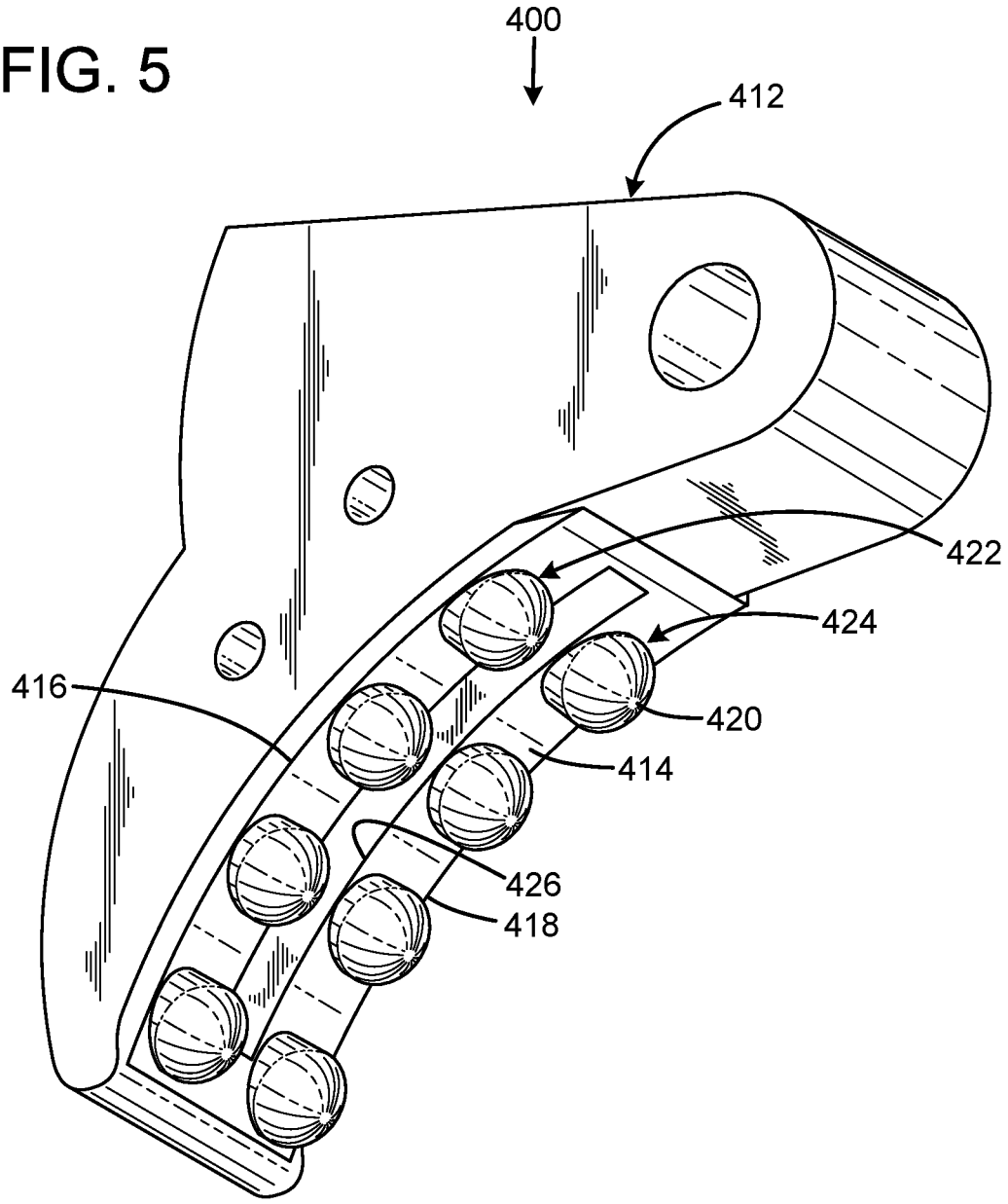
FIG. 5 is a front isometric view of a fourth alternative embodiment of the firearm trigger constructed in accordance with the principles of the present invention for use with a Glock pistol.

FIG. 5 illustrates a fourth alternative embodiment of the improved firearm trigger 400 of the present invention. More particularly, the firearm trigger is suitable for use with a Glock pistol. The firearm trigger has a trigger body 412 that includes an elongated forward actuation surface 414 with opposed edge portions 416, 418. The forward actuation surface includes eight spaced-apart protrusions 420 that are arranged in a pair of elongated arrays/columns 422, 424 along the length of the forward actuation surface and defines a medial gap 426. Each column has four protrusions and is proximate to a respective one of the opposed edge portions. The protrusions are arranged in a plurality of pairs of adjacent protrusions and are spaced apart from each other by portions of the forward actuation surface. The pairs are distributed along the length of the forward actuation surface. In the current embodiment, the protrusions are convex hemispheres, round, positively curved surfaces, surfaces of revolution, and have a vertical dimension along the length of the forward actuation surface and a perpendicular lateral dimension equal to the vertical dimension. In the current embodiment, the protrusions have a diameter of at least 1 mm and no greater than 5 mm, a height of at least 1 mm and no greater than 4 mm, and a center to center distance of at least 2 mm and no greater than 10 mm within a single column and between adjacent columns. The protrusions can also be flat or cone-shaped instead of round.

While current embodiments of a firearm trigger have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the protrusions of the current invention are suitable for a wide variety of firearm and non-firearm related applications.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm trigger comprising:

a trigger body;

the trigger body having a vertical elongated forward actuation surface;

the forward actuation surface including a plurality of spaced-apart protrusions; and the protrusions being arranged in a vertical elongated array.

2. The firearm trigger of claim 1 wherein the protrusions are convex hemispheres.

3. The firearm trigger of claim 1 wherein the protrusions are round.

4. The firearm trigger of claim 1 wherein the protrusions include positively curved surfaces.

5. The firearm trigger of claim 1 wherein the protrusions include surfaces of revolution.

6. The firearm trigger of claim 1 wherein the protrusions are spaced apart from each other by portions of the forward actuation surface.

7. The firearm trigger of claim 1 wherein the protrusions are arranged in a pair of columns each extending along the length of the forward actuation surface.

8. The firearm trigger of claim 7 wherein the forward actuation surface includes opposed edge portions, and wherein each column is proximate to a respective one of the edge portions.

9. The firearm trigger of claim 7 wherein each column contains at least three of the protrusions.

10. The firearm trigger of claim 7 wherein each column contains at most six of the protrusions.

11. The firearm trigger of claim 7 wherein each column contains five of the protrusions.

12. The firearm trigger of claim 7 wherein the trigger body defines a medial gap, and wherein the columns are arranged on opposite sides of the gap.

13. The firearm trigger of claim 7 where the protrusions of each column are staggered with respect to the protrusions of the other column.

14. The firearm trigger of claim 1 wherein the protrusions are arranged in a plurality of pairs of adjacent protrusions, the pairs being distributed along the length of the forward actuation surface.

15. The firearm trigger of claim 1 including a single column of the protrusions.

16. The firearm trigger of claim 15 wherein the column contains at least three of the protrusions.

17. The firearm trigger of claim 1 wherein each of the protrusions has a vertical dimension along the length of the forward actuation surface and a perpendicular lateral dimension equal to the vertical dimension.

18. The firearm trigger of claim 17 wherein the protrusions are spaced apart by a spacing distance at least half that of the vertical dimension.

19. The firearm trigger of claim 1 wherein the protrusions protrude from the forward actuation surface by a distance of at least 1 mm.

* * * * *